United States Patent [19]

Goldaniga René F. et al.

[11] Patent Number: 4,480,697

[45] Date of Patent: Nov. 6, 1984

[54] METHOD AND APPARATUS FOR CONVERTING AN OIL WELL TO A WELL WITH EFFLUENT RAISING BY GAS-LIFT

[75] Inventors: René F. Goldaniga, Gignac; Géard Walter, Vaux le Penil; Bernard J. P. Glotin, Saint Maur; Daniel Gallois, La Grande Paroisse, all of France

[73] Assignees: Compagnie Francaise Des Petroles, Paris, France; Slumberger Technology Corporation, New York, N.Y.

[21] Appl. No.: 469,054

[22] Filed: Feb. 23, 1983

[30] Foreign Application Priority Data

Feb. 26, 1982 [FR] France ..... 82 03198

[51] Int. Cl.[3] ..... E21B 43/14

[52] U.S. Cl. ..... 166/372; 166/375; 166/102; 166/322

[58] Field of Search ..... 166/372, 373, 374, 375, 166/382, 386, 387, 377, 378, 102, 237, 208, 209, 211, 319, 321, 322

[56] References Cited

U.S. PATENT DOCUMENTS

| | | | |
|---|---|---|---|
| 3,642,070 | 2/1972 | Taylor et al. | 166/372 |
| 3,844,352 | 10/1974 | Garrett | 166/372 |
| 3,937,280 | 2/1976 | Pinning | 166/321 |
| 4,407,363 | 10/1983 | Akkerman | 166/237 |

FOREIGN PATENT DOCUMENTS

| | | | |
|---|---|---|---|
| 48006 | 6/1980 | United Kingdom | 166/322 |

*Primary Examiner*—Stephen J. Novosad
*Assistant Examiner*—William P. Neuder
*Attorney, Agent, or Firm*—Sughrue, Mion, Zinn, Macpeak and Seas

[57] ABSTRACT

The present invention relates to a method of and apparatus for converting an oil well with natural effluent rise to one with gas-lift of the effluent column, wherein the oil well has a nipple in the production tube provided with a stop-groove and smooth bearing surfaces between which a hydraulic control line comes out. For conversion an inner tube is lowered inside the production tube, the inner tube being provided with a locking system for locking the inner tube to the nipple, and with a safety valve assembly capable of closing both the passage inside the inner tube and the annular passage between the latter and the production tube, under the action of a control fluid supplied by the control line which opens between two seals on the inner tube and which bear against the smooth bearing surfaces when locking is effected.

In use, lift-gas is supplied to the annular passage between the inner tube and the production tube, and enters the inner tube, through which the effluent rises, through a gas lift valve provided in the inner tube below the safety valve assembly.

18 Claims, 13 Drawing Figures

METHOD AND APPARATUS FOR CONVERTING AN OIL WELL TO A WELL WITH EFFLUENT RAISING BY GAS-LIFT

The invention relates to the conversion of an oil well with natural effluent rise to an oil well with effluent raising by gas-lift of the effluent column.

A conversion of this type currently necessitates considerable modification of the initial completion of the well and, in particular, raising of the whole production tube to the surface in order to fit it with mandrels having side pockets, which receive so-called "gas-lift" valves.

The present invention proposes to avoid the raising of the production tube and to permit economic conversion of a well inside the initial completion.

The present invention is applicable to any oil well, offshore or onshore, of which the production tube, provided for natural effluent rise, is fitted with a nipple having a stop-groove and smooth internal bearing means between which a control line opens, which nipple may be intended, in particular, for receiving a safety valve, which is hydraulically controlled from the surface and which can be raised to the surface, for example by a cable. In fact, the invention takes advantage of the existence of this nipple to carry out the conversion in the initial completion.

According to one aspect of the invention there is provided a method of converting an oil well of which the initial completion comprises a production tube for natural effluent rise, which is fitted with a nipple having a stop-groove and smooth internal bearing means between which a control line originating from the surface opens, into an oil well with effluent raising by gas-lift of the effluent column, comprising lowering an inner tube inside the production tube, the inner tube being fitted with a locking assembly for locking the inner tube to the nipple, and with safety valve means capable of closing both the passage inside the inner tube and the annular passage between the inner tube and the production tube, under the action of a control fluid supplied between two seals of the safety valve means, which are arranged to be applied against the smooth internal bearing means when the inner tube is locked to the nipple, the said lowering of the inner tube being continued until the inner tube is locked to the nipple, one of the said passages is connected on the surface to a source of pressurized gas, the other of the said passages is connected to an effluent discharge pipe, and the safety valve means is opened.

According to another aspect of the present invention there is provided apparatus for introduction into an oil-well production tube provided with a nipple having a stop-groove, smooth internal bearing means and an inlet for a hydraulic control line between the bearing means, for converting the oil well to an oil well with effluent raising by gas-lift of the effluent column, the apparatus comprising an inner tube having a boss and provided with a locking assembly which surrounds the inner tube, which can undergo a longitudinal displacement relative to the inner tube if it is held during a descending movement of the inner tube, and which comprises first and second retractable stopping means such that, during a said relative longitudinal displacement, the boss on the inner tube moves the first stopping means radially outwards, and the second stopping means take up an engaged position rendering the inner tube fast with the locking assembly, the inner tube also being provided with safety valve means comprising two outer seals, at least one control-fluid inlet located between the two seals, longitudinal internal passage means connecting the space outside the inner tube on either side, longitudinally, of the assembly comprising the two seals, first closing means capable of closing or opening the said longitudinal internal passage means, second closing means capable of closing or opening the passage formed inside the said inner tube, and hydraulic and mechanical transmission means between the said inlet and the said first and second closing means for operating the first and second closing means.

The locations of and diameters of the first stopping means and of the seals are determined according to the locations and diameters of the stop-groove and of the smooth internal bearings of the nipple into which apparatus is to be inserted.

An embodiment according to the invention will now be described, by way of example only, with reference to the accompanying drawings, in which.

Figure 1:
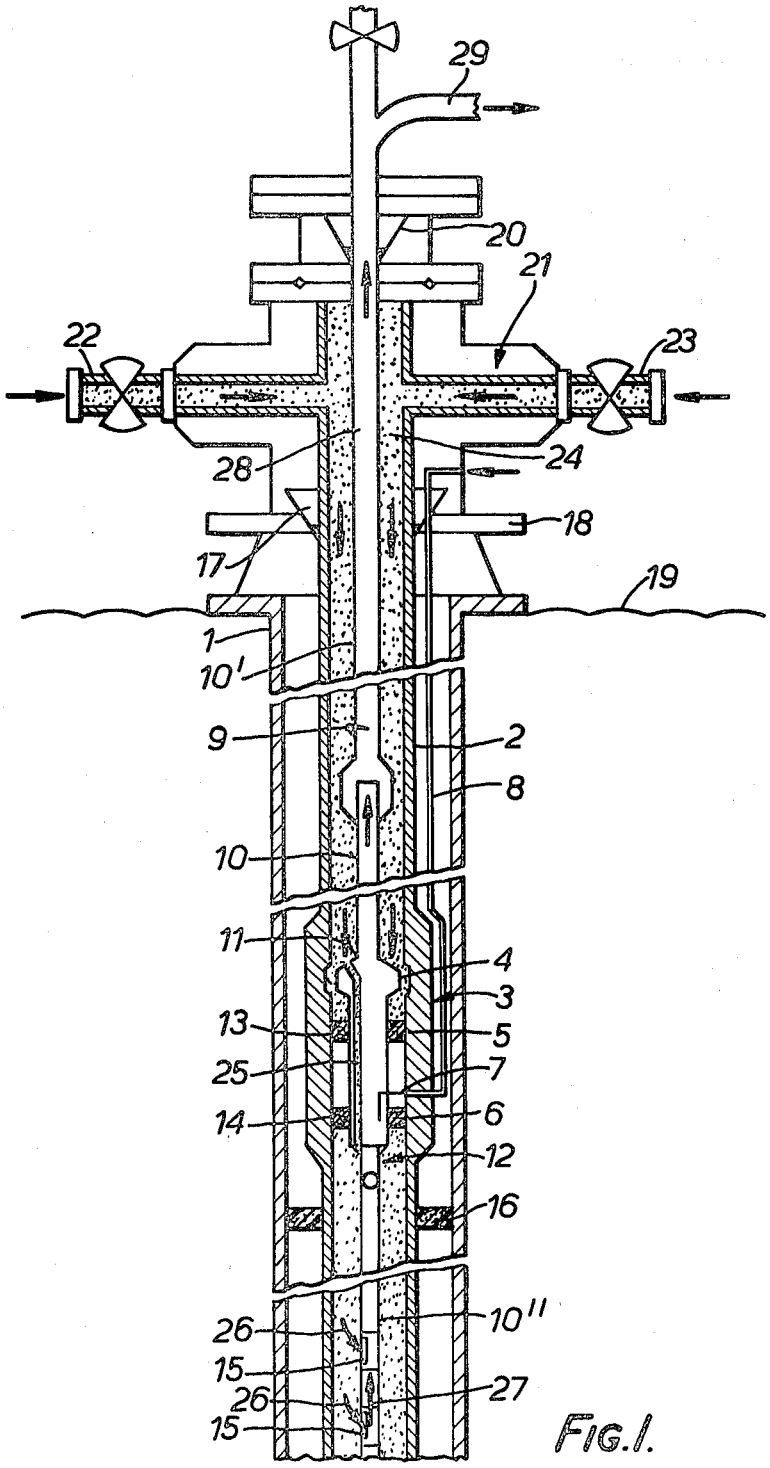
FIG. 1 shows, in partial vertical section, an oil well converted to an oil well with effluent raising by gas-lift according to embodiment of the present invention.

An oil well is shown in FIG. 1 comprising a casing 1 and a production tube 2 fitted, for example at a depth of 100 to 150 meters, with a nipple 3 having an internal stop-groove 4 and smooth internal bearing surfaces 5 and 6 separated by an opening 7 for a line 8 for supplying a control fluid, which has been converted to an oil well with effluent raising by gas-lift. For this purpose, an internal device 9 has been introduced into the production tube 2 after the removal of a safety valve, not shown here, which was initially mounted on the nipple 3.

The internal device 9 comprises an inner tube 10 extended by an upper tube 10' and by a lower tube 10", a locking assembly 11 capable of locking the inner tube 10 in the stop-groove 4, and a valve assembly 12 capable of closing both the passage inside the tube 10 and a passage created between the tube 10 and the production tube 2. The valve assembly 12 comprises two seals 13 and 14 pressing against the smooth bearing surfaces 5 and 6 in order to permit control of the valves from the line 8. The lower tube 10" comprises, in its lower part, side valves 15 for the passage of gas (so-called "gas-lift" valves).

A sealing device or packer 16 is inserted between the production tube 2 and the casing 1. The production tube 2 is held by a suspension 17 resting on a well head 18 located on the surface 19. The internal device 9 is fitted with a suspension 20 which rests on a Christmas tree 21.

The effluent lift-gas arrives through pipes 22 and 23 from a source of pressurised gas, not shown, which may, for example, comprise pumps. In the Christmas tree 21, this gas passes from these pipes 22 and 23 into the annular space 24 between the tubes 2 and 10'. Passages inside the locking assembly 11 and valve assembly 12, shown very diagrammatically by 25 in FIG. 1, connect the upper portion of the annular space 24 between the tubes 2 and 10' to the lower portion of this annular space 24 between the tubes 2 and 10". The lift-gas passes into the side valves 15, in the direction of the arrows 26, and mixes inside the lower tube 10" with the effluent which is rising in the direction of the arrow 27. The upper end of the passage 28 inside the inner tube 10' is connected to an effluent discharge pipe 29.

Figure 2:
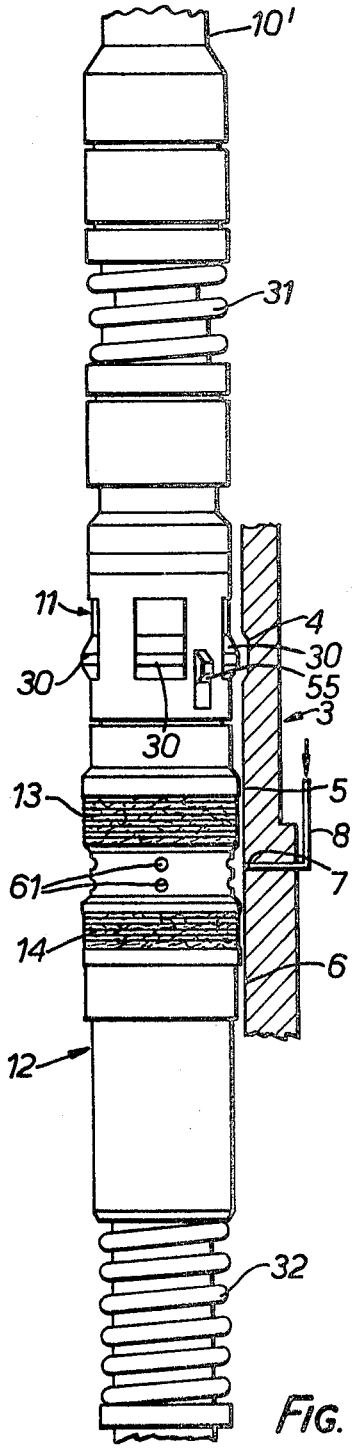
FIG. 2 shows a vertical view of the locking assembly and safety valves means portion of the apparatus which has been introduced to permit the conversion of the well according to the present invention.

FIG. 2 shows, on a larger scale, an external view of the locking assembly 11 and valve assembly 12. This figure shows first stop-keys 30 of the locking assembly 11, which are intended to fit into the groove 4 in the nipple 3. In this position, the seals 13 and 14 press against the bearing surfaces 5 and 6 respectively. This figure also shows a spring 31 forcing the locking assembly 11 downwards, and a spring 32 for returning the valves of the assembly 12 to the closed position. The purpose and the operation of these members will become apparent from the description of FIGS. 3, 8 and 9.

Figure 3:
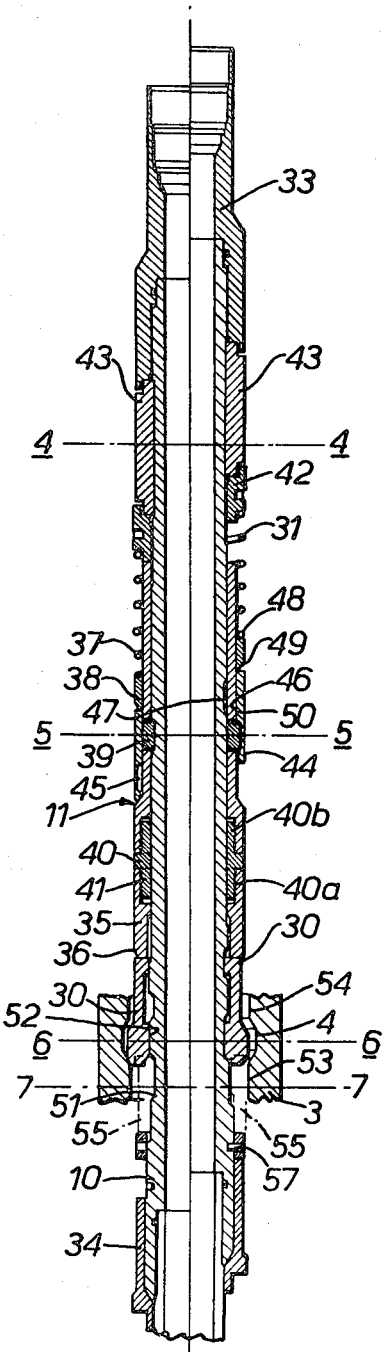
FIG. 3 shows a vertical section of the locking assembly of FIG. 2.

FIG. 3 shows the locking assembly 11, the right-hand part of this figure corresponding to the unlocked position and the left-hand part to the locked position of this assembly.

This locking assembly 11 is arranged around the inner tube 10, between an upper tubular element 33, which forms a connector between the two tubes 10 and 10' and which is firmly fixed to the inner tube 10, and a lower tubular element 34, which also forms a connector between the two tubes 10 and 10" and which is also firmly fixed to the inner tube 10. The locking assembly 11 comprises a lower cylindrical lantern 35 and an upper cylindrical lantern 37; the first stop-keys 30 are housed in openings 36 in the lantern 35 and second stop-keys 39 are housed in openings 38 in the lantern 37. These two lanterns 35 and 37 are connected to one another by an intermediate part 40 whose breaking strength under tension is gauged by means of a weakened zone 41 of reduced thickness, in which holes can be made, the number and diameter of which are calculated so as to obtain the desired breaking strength. This intermediate part 40 is made of two half-shells and is screwed onto the two lanterns 35 and 36 by means of screw-threads 40*a* and 40*b*.

Figure 4:
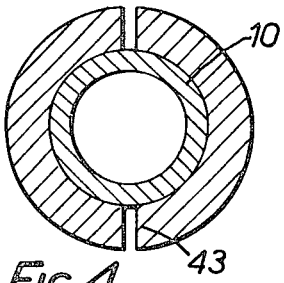
FIGS. 4 to 7 show cross-sections taken along the lines 4—4, 5—5, 6—6 and 7—7 of FIG. 3.
Figure 5:
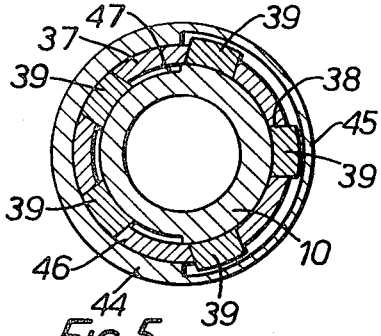

The spring 31 does not bear directly against the upper tubular element 33, but against a nut 42 screwed to the inner tube 10 and clamping a ring made of two half-shells 43, shown more clearly in FIG. 4, against the upper tubular element 33. On the same side as the lantern 37, the spring 31 bears against a cylindrical cap 44 having a lower portion 45 of larger internal diameter and an upper portion 46 of smaller internal diameter. The lower portion 45 of the cap 44 covers the second stop-keys 39 when the keys are in the unlocked position, and the upper portion 46 of the cap 44 covers the second stop-keys 39 when the second stop-keys 39 are in the locked position, that is to say when they enter a groove 47 in the inner tube 10. FIG. 5 shows the keys 39, of which there are five as shown. A ring 48 is intercalated between the cap 44 and the lower end of the spring 31. Between itself and the cap 44, this ring holds an elastic clip 49 against the lantern 37, the clip 49 being capable of being inserted into a small groove 50 in the lantern 37.

Figure 6:
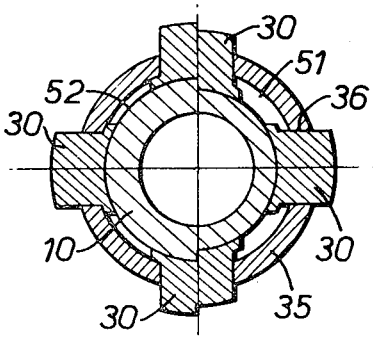

As shown in FIGS. 3 and 6, the first stop-keys 30, of which there are four as shown, can assume positions in which they have been moved radially inwardly or outwardly, according to whether they are located opposite a recess 51 in the inner tube 10 or opposite a boss 52 on the inner tube 10.

Figure 7:
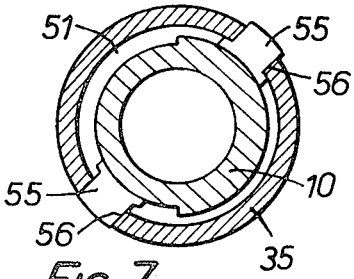

On either side of the groove 4, the nipple 3 comprises lower and upper portions 53 and 54 which are such that the internal diameter of the lower portion 53 is slightly less than that of the upper portion 54. Special stops 55, of which there are two as shown, are provided; these stops are inserted in openings made in the lantern 35 and are each provided with a radially external nose for coming up against the lower portion 53 during the lowering of the internal device 9. These stops 55, which are only shown in dot-and-dash lines in FIG. 3, are shown more clearly in FIG. 7 and in FIG. 2. These stops retract when they are located opposite a recess 56 in the inner tube 10, situated just below the recess 51 and less deep than the latter.

A shear pin 57 temporarily joins the lower part of the lantern 35 and the inner tube 10 during the lowering of the internal device 9.

Figure 8:
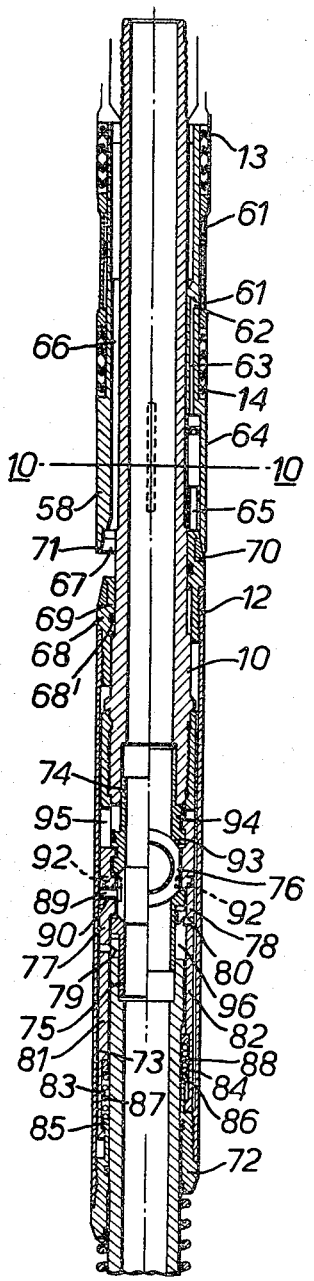
FIGS. 8 and 9 show vertical sections of the upper part and the lower part, respectively, of the safety valves means of FIG. 2.
Figure 9:
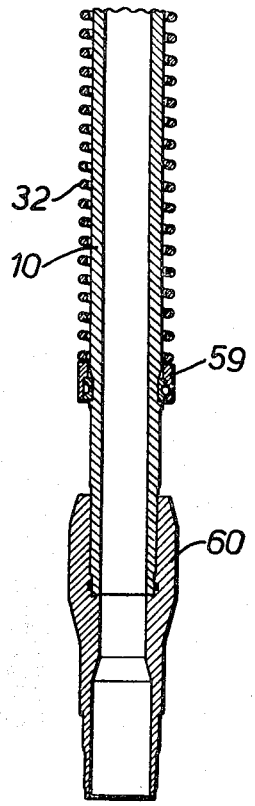

FIGS. 8 and 9 show the valve assembly 12, the left-hand part of these figures corresponding to the open position of these valves and the right-hand part of these figures corresponding to the closed position of the valves. The valve-operating members are arranged between an upper sleeve 58, fixed around the inner tube 10, and a lower stop 59, fixed to the inner tube 10 and serving as a support for the return spring 32. Below the stop 59, the inner tube 10 carries a connector 60 to which the tube 10" is connected.

Figure 10:
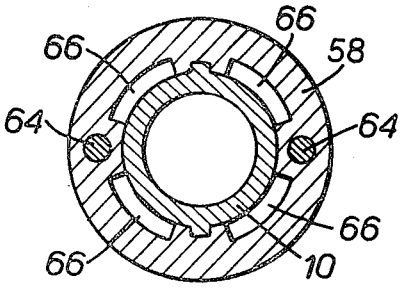
FIG. 10 shows a cross-section taken along the line 10—10 of FIG. 8.

The upper sleeve 58 carries the two seals 13 and 14 between which holes 61 (see also FIG. 2) are provided to allow a control fluid coming from the line 8 (see FIG. 2) to enter an annular collector 62 communicating via passages 63 with jacks 64, the pistons 65 of which are thus displaced downwards. Passages 66 for the lift-gas are made in this sleeve 58. FIG. 10 provides a clearer understanding of the respective arrangement of the jacks and passages. In the left-hand part of FIG. 8, the section has been taken through a passage 66 instead of through a jack 64, in order to provide a clearer understanding of the construction. The passages 66 come out at the bottom of the sleeve 58 into an annular outlet opening of widened cross-section 67. It is this outlet opening 67 which is opened or closed by a valve 68 whose purpose is to cut off the passage of the gas between the inner tube 10 and the production tube 2.

The cut-off valve 68 is in the form of a jacket slidable along the inner tube 10, with the interposition of a seal 68', and carrying, in its upper part, a bearing surface 69 on which the piston 65 bears, and an adjacent conical portion 70, made of an additional material such as rubber, providing a seal for sealing against the widened inner edge 71 of the sleeve 58, which runs around the edge of the annular outlet opening 67 and which forms a valve seat.

The return spring 32 acts on a slide-block 72 slidable along the inner tube 10. Thus, the two-valve assembly is caused to open by the lowering of the valve 68 and to close by the rising of the slide-block 72. As the slide-block 72 is joined to the valve 68 by a cylindrical envelope 73, the closing and opening movements of the valve 68 are directly dependent on the upward displacement of the spring 32 and on the downward displacement of the piston 65 of the jack 64.

Figure 11:
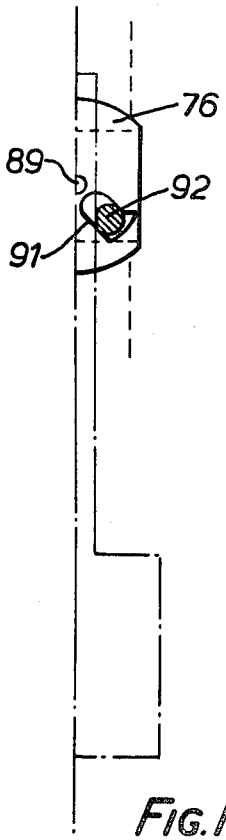
FIGS. 11, 12 and 13 are diagrams, in a vertical representation orthogonal to FIG. 8, showing the successive displacements of the spherical valve-spool during the change from the closed position to the open position.
Figure 12:
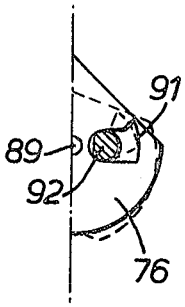
Figure 13:
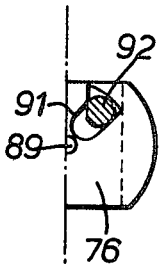

On the other hand, the sliding unit which operates the valve for closing the internal passage of the inner tube 10 is joined to the slide-block 72 by a mechanical connection with play, so that the closing movements of the two valves are not entirely interdependent. This moveable unit comprises two tubular portions sliding in the inner tube 10, namely an upper tubular portion 74 and a lower tubular portion 75, enclosing a spherical spool 76 between them, and joining parts 77 and 78 fitted with clamping screws 79 and 80 and extended downwards by arms 81, 82, which end in oblong recesses 83, 84 in which claws 85, 86, firmly fixed to the slide-block 72, can move in the vertical direction, a compression spring 87, 88 being placed in each of these recesses, between one of these claws and the upper edge of the recess. The spherical spool 76 can rotate relative to the rest of this sliding unit because it is carried by an axle 89 accommodated in housings 90 in the joining parts 77 and 78, and it is in fact caused to rotate during the translational movement of the sliding unit because it possesses millings 91 into which pins 92 carried by the inner tube 10 penetrate. These pins 92 are only shown in broken lines in FIG. 8, but their function is understood more clearly with reference to FIGS. 11, 12 and 13. The upper tubular portion 74 constitutes the valve seat and it is fitted with gaskets 93 and 94 providing a seal with the spherical spool 76 and the inner tube 10, respectively. The joining parts 77 and 78 pass through the inner tube 10 in openings 95 and 96, the arms 81 and 82 being located in the space between the inner tube 10 and the envelope 73.

The locking assembly 11 operates as follows. When the internal device 9 is lowered inside the production tube 2, the stops 55 are stopped by their noses on the lower portion 53 running round the edge of the groove 4 in the nipple 3. The pin 57 shears and the inner tube 10 continues to descend, which continued movement causes the first stop-keys 30 to move radially away from one another under the action of the boss 52 and into engagement with groove 4 in nipple 3, while the noses of the stops 55 are retracted by virtue of the recess 56, and introduces the second stop-keys 39 into the groove 47. These second stop-keys are held in the groove 47 by the cap 44, of which the portion 46 of smaller internal diameter covers the keys 39 under the action of the spring 31. The inner tube 10 is then held in place, against upward or downward vertical forces, by the rigid connection provided by the following parts: the keys 39, the upper lantern 37, the intermediate part 40, the lower lantern 35, the keys 30 and the nipple 3. The elastic clip 49 engaged in the small groove 50 provides additional security.

If it is desired to withdraw the device 9, a strong pull is exerted on the inner tube 10 from the surface 19, which breaks the intermediate part 40 and separates the lower lantern 35 from the inner tube 10. The latter can then be raised, firstly by a short height to bring the lower lantern 35 into the position shown on the right-hand side of FIG. 3, and to release the first stop-keys 30 from the nipple 3, and then up to the surface.

On the surface, dismantling is facilitated by the nut 42, which, when unscrewed, releases the two half-shells of the ring 43. Removal of the nut 42 then provides the space necessary for replacement of the intermediate part 40.

The valves operate as follows. When control fluid is sent through the line 8, the piston 65 of the jack 64 opens the valve 68, and the slide-block 72, carried along by the cylindrical envelope 73, pulls the arms 81 and 82—with a slight delay caused by the play provided—via the claws 85 and 86, as soon as the latter reach the bottom of the recesses 83 and 84. The arms 81 and 82 are then pulled downwards, which moves downwards the sliding unit consisting of the parts 74, 75, 76, 77 and 78 and causes the rotation of the spherical spool 76, held by the pins 92, in order to bring it into its open position.

If the introduction of control fluid into the line 8 is stopped, the return spring 32 acts by itself and closes the valves. The slide-block 72 raises the valve 68 to which it is rigidly joined by the cylindrical envelope 73. As soon as it begins to rise, this slide-block 72 starts to compress the springs 87 and 88, which tends to raise the arms 81 and 82 and the sliding unit 74, 75, 76, 77 and 78, the closing movement of the spherical spool 76, initiated in this way, normally being completed by the action of the pressurised gas/effluent mixture located under the spool. The spherical spool 76 is then kept in the closed position by the pins 92 engaged in the millings 91, the configuration of which is provided for this purpose, while the assembly comprising the slide-block 72, the envelope 73 and the valve 68 continues its rising movement until the annular outlet 67 is cut off. The play provided in the mechanical transmission of the movement between the slide-block 72 and the arms 81 and 82 makes it possible to take advantage of the action of the gas/effluent mixture for rapid closure of the spherical spool valve 76. In any case, if this valve offered an abnormal resistance to closure, its closure would be ensured by the slide-block 72 at the end of its rising movement, at the same time as the valve 68 cuts off the annular outlet 67.

The above described apparatus, which can be installed very economically, thus includes means for sealing the annular space between the inner tube and the production tube and the passage inside the inner tube. It includes a retractable anchorage which is capable of withstanding both the weight of the inner tube (the central portion located in the region of the locking assembly and the safety valve means, and upper and lower extensions thereof, and the upward forces due to the pressure, and is very safe on account of its position protected from the shocks to which the well head can be subjected.

It is self-evident that the construction which has just been described can form the subject of numerous modifications without exceeding the scope of the invention.

What is claimed is:

1. A method of converting an oil well, which initially includes a production tube (2) for natural effluent rise, which production tube is fitted with a nipple (3) having a stop-groove (4) and smooth internal (5,6) bearing means between which a control line (8) originating from the surface opens, into an oil well with effluent raising by gas-lift of the effluent column, the method comprising lowering only once an inner tube (10) inside said production tube (2), said inner tube being fitted with a locking assembly (11) for locking said inner tube to said nipple, two seals (13,14) for sealing against said smooth internal bearing means, and safety valve means (12) capable of closing both a passage inside said inner tube and an annular passage (66) between said inner tube and said production tube, under the action of a control fluid supplied between said seals, said lowering of said inner tube being continued until said inner tube is locked to the nipple, one of said passages being connected on the surface to a source of pressurised gas, the other of the said passages being connected to an effluent discharge pipe, said seals being applied against said smooth internal bearing means, and the safety valve means is opened.

2. Apparatus to be introduced into an oil-well production tube fitted with a nipple having a stop-groove, smooth internal bearing means and an inlet for a hydraulic control line between the smooth bearing means, for converting the oil well to an oil well with effluent raising by gas-lift of the effluent column, said apparatus comprising; an inner tube (10) having a boss (52) and provided with a locking assembly (11) which surrounds said inner tube, and which can undergo a longitudinal displacement relative to said inner tube if it is held during a descending movement of said inner tube, said locking assembly (11) comprising first and second retractable stopping means (30,39) such that, during a said relative longitudinal displacement, said boss (52) on said inner tube will move said first stopping means radially outwards, and said second stopping means will take up an engaged position (47) rendering said inner tube fast with said locking assembly, said inner tube also being provided with safety valve means comprising two outer seals (13,14), at least one control-fluid inlet (7) located between said two seals, longitudinal internal passage means (66) connecting the space outside said inner tube on either side, longitudinally, of the assembly comprising said two seals, first closing means (68) capable of closing or opening said longitudinal internal passage means, second closing means (76) capable of closing or opening the passage formed inside said inner tube, and hydraulic and mechanical transmission means between said inlet and said first and second closing means for operating said first and second closing means.

3. Apparatus according to claim 2, wherein said second stopping means comprises stop-keys (39) arranged to be accommodated by a groove (47) provided in the inner tube during said relative longitudinal displacement.

4. Apparatus according to claim 2, wherein said first closing means comprises a longitudinally slidable valve (68) capable of closing said longitudinal internal passage means.

5. Apparatus according to claim 2, wherein said second closing means (76) comprises a valve operable by longitudinally slidable means (74,75).

6. Apparatus according to claim 2, wherein said locking assembly comprises retractable auxiliary stops (55) provided longitudinally below said first stopping means, said inner tube being provided with a recess (56) located longitudinally below said boss and arranged for accommodating said auxiliary stops (55) when said inner tube (10) and said locking assembly (11) are in the relative position in which said first stopping means (30) are opposite said boss (52).

7. Apparatus according to claim 3, wherein said locking assembly comprises a slidable cap (44) which surrounds said stop-keys of said second stopping means, said slidable cap (44) comprising a portion (45) of larger internal diameter and a portion of smaller (46) internal diameter, and which is acted upon by resilient means (31) so as to press said portion of smaller internal diameter externally against said stop-keys when they are accommodated in said groove in said inner tube.

8. Apparatus according to claim 2, wherein said locking assembly comprises a lower lantern (35) and an upper lantern (37), said first stopping means (30) being arranged in openings in said lower lantern (35) and said second stopping means (39) being arranged in openings in said upper lantern (37), said lower and upper lanterns being connected to one another by an intermediate part (40) of gauged breaking strength under tension.

9. Apparatus according to claim 8, wherein the lantern assembly comprising said lower lantern and said upper lantern is mounted so as to be slidable below a tubular element (33) surrounding said inner tube and fixed thereto, a resilient means (31), acting in compression, being interposed between said tubular element and said lantern assembly.

10. Apparatus according to claim 7, wherein said locking assembly comprises a lower lantern (35) and an upper lantern (37), said first stopping means (30) being arranged in openings (36) in said lower lantern and said second stopping means (39) being arranged in openings (38) in said upper lantern, said lower and upper lanterns being connected to one another by an intermediate part (40) of gauged breaking strength under tension, the lantern assembly comprising said lower lantern and said upper lantern is mounted so as to be slidable below a tubular element (33) surrounding said inner tube and fixed thereto, said resilient means (31) being interposed between said tubular element (33) and said slidable cap (44), said cap surrounding said upper lantern and having its portion of smaller diameter located longitudinally above its portion of larger internal diameter.

11. Apparatus according to claim 10, wherein a ring (48) and an elastic clip (49), located below said ring, are provided between said resilient means and said cap, said upper lantern being provided with a small groove (50) for accommodating said elastic clip when the portion of smaller diameter of said cap covers said stop-keys.

12. Apparatus according to claim 9, including a ring (43) made of two half-shells, held against said tubular element by a nut (42) screwed to said inner tube, and provided between said tubular element and said resilient means.

13. Apparatus according to claim 8, wherein said lantern assembly is initially held in the unlocked position of said locking assembly by a shear pin (57) connecting one of said lanterns to said inner tube.

14. Apparatus according to claim 2, comprising a sleeve (58) fixed around said inner tube and carrying said two seals, wherein at least one jack (64) is mounted in said sleeve, and said first and second closing means form an assembly installed between said at least one jack and a return spring (32) actong in opposition to said at least one jack located longitudinally on the other side of said assembly, and compressed against the assembly, while being held by a stop (59) fixed to said inner tube.

15. Apparatus according to claim 14, wherein said first closing means comprises a longitudinally slidable valve (68) which is provided with a bearing surface (69) for receiving a thrust from said at least one jack, said slidable valve is rigidly connected by a cylindrical envelope (73) to a slide-block (72) on which said return spring acts, and said second closing means comprises a valve operated by longitudinally slidable means (74,75) joined to said slide-block by a mechanical connection with play, which tends to be compensated by at least one spring (87,88) which is compressed when said return spring acts by itself in said safety valve.

16. Apparatus according to claim 5, wherein said second closing means comprises a spherical spool valve (76), and said slidable means for operating said second closing means comprises two tubular portions (74,75) slidable inside said inner tube and calmping between them said spherical spool valve which is provided with an axle (89) mounted in housings (90) in joining parts (77,78) which hold said two tubular portions together, with said spherical spool valve inserted between them, millings (91) in said spherical spool valve accommodating pins (92) carried by said inner tube (10).

17. Apparatus according to claim 15, wherein said second closing means comprises a spherical spool valve (76), and said slidable means for operating said second closing means comprises two tubular portions (74,75) slidable inside said inner tube and clamping between them said spherical spool valve which is provided with an axle (89) mounted in housings (90) in joining parts (77,78) which hold said two tubular portions together, with said spherical spool valve inserted between them, millings (91) in said spherical spool valve accommodating pins (92) carried by said inner tube, said joining parts passing through openings (95,96) in said inner tube and extending into the space between said inner tube and said cylindrical envelope by means of arms (81,82) forming part of said mechanical connection means.

18. Apparatus according to claim 4, wherein said lower part of said longitudinal internal passage means ends in an annular outlet opening (67), and said slidable valve comprises a conical portion (70) for closing said annular outlet opening.

* * * * *